US006024071A

United States Patent [19]

Heimberg et al.

[11] Patent Number: 6,024,071

[45] Date of Patent: Feb. 15, 2000

[54] PROCESS FOR DRIVING THE EXCITING COIL OF AN ELECTROMAGNETICALLY DRIVEN RECIPROCATING PISTON PUMP

[75] Inventors: Wolfgang Heimberg; Knut Bartsch, both of Ebersberg, Germany

[73] Assignee: FICHT GmbH & Co. KG, Kirchseeon, Germany

[21] Appl. No.: 08/945,706

[22] PCT Filed: Apr. 24, 1996

[86] PCT No.: PCT/EP96/01716

§ 371 Date: Feb. 23, 1998

§ 102(e) Date: Feb. 23, 1998

[87] PCT Pub. No.: WO96/34192

PCT Pub. Date: Oct. 31, 1996

[30] Foreign Application Priority Data

Apr. 28, 1995 [DE] Germany ..... 195 15 775

[51] Int. Cl.[7] ..... F02M 51/00

[52] U.S. Cl. ..... 123/490; 123/499; 361/154

[58] Field of Search ..... 123/490, 499; 361/140, 146, 153, 154

[56] References Cited

U.S. PATENT DOCUMENTS

| | | | |
|---|---|---|---|
| 4,173,031 | 10/1979 | Leichle | 361/154 |
| 4,238,813 | 12/1980 | Carp et al. | 123/490 |
| 4,473,861 | 9/1984 | Kosak et al. | 361/154 |
| 4,520,420 | 5/1985 | Ariyoshi et al. | 123/490 |
| 4,729,056 | 3/1988 | Edwards et al. | 361/153 |
| 4,980,793 | 12/1990 | Glowczewski et al. | 123/490 |
| 5,381,297 | 1/1995 | Weber | 361/154 |

*Primary Examiner*—Erick R. Solis
*Attorney, Agent, or Firm*—Fletcher, Yoder & Van Someren

[57] ABSTRACT

A method for signalling an energizing coil of a solenoid-operated reciprocating plunger pump employed as a fuel injection device, in which the energizing coil is energized via a current control circuit pulsed at high-frequency by an energizing current and each pulse causes an impulse movement of an armature driven by the energizing coil, and the current control circuit controls the energizing current flowing through the energizing coil as a function of a current setpoint curve, each pulse of the current setpoint curve comprises a gradually rising leading edge resulting in a corresponding gradually rising leading edge of the pulse of the energizing current in the energizing coil, the current setpoint curve being controlled so that the energizing current does not change faster than the maximum change in current possible for the minimum voltage available at the energizing coil and limited due to mutual induction.

10 Claims, 6 Drawing Sheets

PROCESS FOR DRIVING THE EXCITING COIL OF AN ELECTROMAGNETICALLY DRIVEN RECIPROCATING PISTON PUMP

BACKGROUND OF THE INVENTION

1. Field of the Invention

The invention relates to a method for signalling an energizing coil of a solenoid-operated reciprocating plunger pump as set forth in the preamble of claim 1.

2. Description of Related Art Including Information Disclosed Under 37 CFR 1.97 and 1.98

One such method of signalling an energizing coil of a solenoid-operated reciprocating plunger pump is known from PCT/EP 93/00494. In this method a current control circuit is employed which controls the energizing current flowing through the energizing coil 600 (FIG. 1) as a function of the current setpoint in the form of a current or voltage setting. The energizing coil 600 is connected to a power transistor 601 which is connected to ground via a precision resistor 602, a comparator 602 being connected by its output to the control input of the transistor 601, for example, to the base of the transistor. The non-inverting input of the comparator 603 receives the current setpoint, obtained for example by means of a microcomputer. The inverting input of the comparator 603 is connected to one side of a resistor which is connected to the transistor 601. This circuit is a bang-bang control system which limits the current flowing through the energizing coil as a maximim, depending on the applied current setpoint, ON/OFF action of the power transistor 601 chopping roughly delta-shaped the current flow through the energizing coil in the control range.

In this application of the method the current setpoint is applied in the form of square wave pulses to the comparator 603, the length of the pulses dictating the duration of the corresponding energizing pulse and the amplitude of the pulse dictating the maximum current flowing through the energizing coil.

By this method different amounts of fuel can be metered by the reciprocating plunger pump operating more or less independently of coil heating and fluctuations in the supply voltage.

From DE 28 41 781 C2 a means for operating electromagnetic devices in internal combustion engines, more particularly solenoid valves in fuel supply systems, is known. This means controls the current profile of an injection signal at the start of the injection pulse to an excessively high value ensuring that the solenoid valve is opened and holds the current constant at a value slightly below the peak value attained at the start.

In DE 37 22 527 A1 a method of signalling an injector for an internal combustion engine is described in which the energizing coil of the injector is signalled in a way similar to the method as described in DE 28 41 781 C2, whereby, however, at the end of the injection pulse a transition is made from a chopped current regulation, during which the current value oscillates between two threshold values, to a current regulation having a constant current value so that the injector is closed at a precisely predetermined point in time in OFF action, i.e. at the end of the current pulse.

SUMMARY OF THE INVENTION

It is the object of the invention to sophisticate the method cited at the outset so that an amount of fuel injected per injection pulse can be metered highly exactly and achieving this independently of coil heating or fluctuations in the supply voltage.

This object is achieved by a method having the features as set forth in claim 1. Advantageous aspects of the invention are characterized in the sub-claims.

The invention is based on the following findings:

Due to the self-induction in the energizing coil the energizing current fails to directly increase to the maximum strength, instead each energizing current pulse 94 features a leading edge 95 which is proportional to an exponential function (FIG. 2). The slope of the leading edge 95, or the change in current in the energizing coil, is a direct function of the voltage applied to the coil which, in motor vehicles, may greatly depend on changes in load, as is known. On top of this the resistance in the energizing coil alters as a function of changes in temperature so that the leading edges actually occuring differ in slope.

The integral over such an energizing current pulse is roughly proportional to the amount of fuel injected by the fuel injection device per injection pulse, the leading edges 95 significantly influencing the amount of fuel injected per injection pulse so that the differences in the leading edges result in considerably differing amounts of fuel injected.

BRIEF DESCRIPTION OF THE DRAWINGS

The invention will now be described in more detail with respect to the drawing in which.

DETAILED DESCRIPTION OF THE PREFERRED EMBODIMENT(S)

In the method in accordance with the invention a current control circuit is used, as is known, for example, from PCT/EP 93 00494 (FIG. 1) to control the current in an energizing coil of a solenoid-operated reciprocating plunger pump used as a fuel injection device. The energizing coil is excited by high-frequency pulses, each pulse resulting in an abrupt movement of an armature operated by the energizing coil. The current control circuit controls the energizing current as a function of a current setpoint applied pulsed.

In accordance with the invention each pulse of the current setpoint is signalled by a gradually rising leading edge resulting in a correspondingly gradually rising leading edge in the pulse of the energizing current in the energizing coil, whereby the change in the energizing current is no quicker than as permitted by the maximum change in current limited by the mutual induction in the energizing coil possible for the minimum voltage available.

The maximum change in current for the voltage available as a minimum is the change in current resulting if the voltage available as a minimum due to fluctuations in load and temperature were to be applied directly to the energizing coil, and the increase in current in the energizing coil were to be limited by the mutual induction due to the inductance of the energizing coil.

Figure 6:
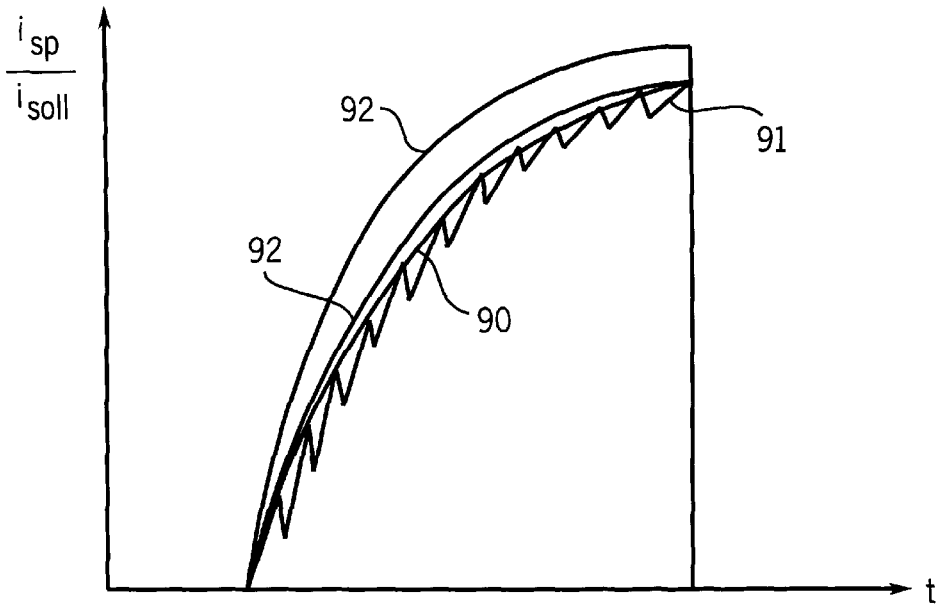
FIG. 6 is a diagram illustrating the pulse profile of the energizing current by the method in accordance with the invention.

By the method in accordance with the invention a current setpoint curve 90 is set at the input of the current control circuit, resulting in a corresponding energizing current 91 in the energizing coil (FIG. 6). The profile of the current setpoint curve 90 is selected so that the resulting energizing current 91 is always in the regulating range of the current control circuit, i.e. the increase in the current setpoint curve 90 is smaller than the maximum change in current at which the voltage available at the energizing coil is at a minimum. As explained above, this voltage may greatly vary, depending on temperature and engine load.

Preferably the profile of the current setpoint curve 90 is below that of a corresponding current curve 92 having a maximum increase for the voltage available at the energizing coil as a minimum. Since the current curve 92 obeys an exponential function due to the mutual induction of the energizing coil 9, 600 (FIG. 1, FIG. 3) it is expedient when the profile of the leading edge of the current setpoint curve 90 is such that it roughly also corresponds to such an exponential function and can be represented by the following equations $$i_{sp}=I_0-e^{-at}I_0 \quad (1)$$

$$u_{sp}=U_0-e^{-at}U_0 \quad (2)$$

where $I_0$ and $U_0$ respectively are base values and a is a parameter to be determined.

Preferably the engine speed and/or the temperature existing at the energizing coil is sensed so that the voltage available at the energizing coil can be determined or the voltage available as a minimum can be estimated to enable the current setpoint curve 90 to be adapted to the voltage conditions actually existing. Adapting in this way is done, for example, by changing the base values or the parameter a.

In adapting the current setpoint curve to the engine conditions it needs to be taken into account that at low speeds of the alternator only a very small voltage is furnished, but the injection actions are spaced away from each other far in time so that the injection action can be controlled with relatively long pulses at low current, whereas at high engine speeds the time available for the injection action becomes smaller all the time, this being the reason why the pulses need to be shortened, whereby due to a higher minimum voltage being available, however, a larger current can be applied to the energizing coil.

The current setpoint curve can be computed by means of a microprocessor, for example, as a function of the crank angle position and applied to the input of the current control circuit as the setting current or setting voltage by a digital/analog converter or by means of pulse-width modulation.

This method is put to use preferably in a pump-injector device as is known, for example, from DD-PS 120 514, from DD-PS 213 472, from DE-OS 23 07 435 or from EP 0 629 265.

Figure 3:
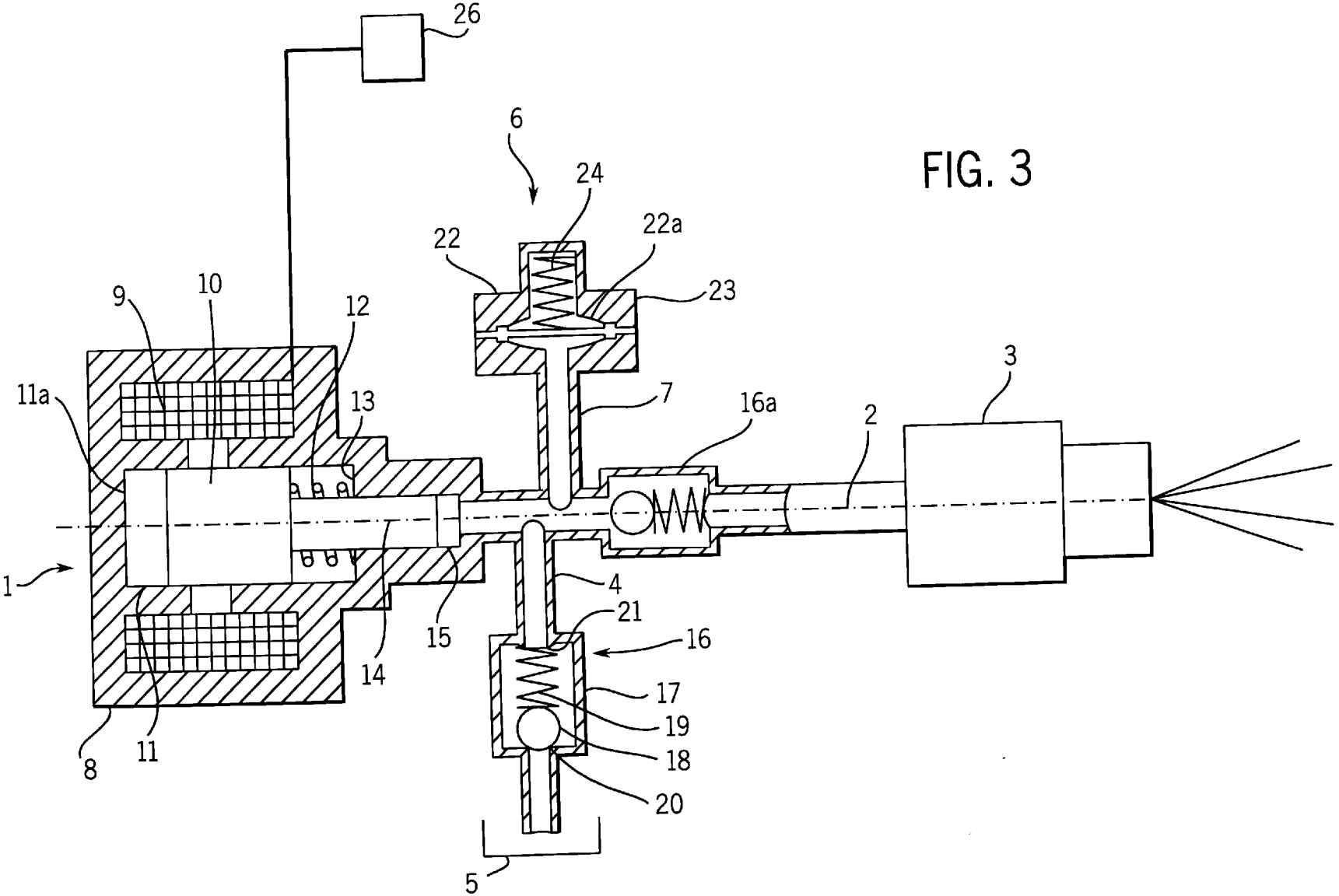
FIG. 3 is an example illustration of a fuel injection device.

One such pump-injector device, based on the solid-state energy storage principle, is illustrated in FIG. 3. In this fuel injection device an initial partial stroke of the delivery element of the injection pump is provided in which the displacement of the fuel results in no pressure being built up, whereby the partial stroke of the delivery element serving to store energy is determined expediently by a storage volume e.g. in the form of a vacant volume and a stop element, both of which can be configured differingly and which permit displacement of the fuel in response to a stroke travel "X" of the delivery element of the reciprocating plunger pump. It is not until the displacement of the fuel is suddenly discontinued that pressure is built up in the fuel abruptly so that displacement of the fuel in the direction of the injector is caused.

The injection device as shown in FIG. 3 comprises a solenoid-operated reciprocating plunger pump 1 connected via a delivery line 2 to an injector 3. Branching off from the delivery line 2 is a suction line 4 which is in connection with a fuel reservoir 5 (tank). In addition, a volume storage element 6 is connected via a conduit 7 to the delivery line 2 roughly in the region of the connection of the suction line 4.

The pump 1 is configured as a reciprocating plunger pump and has a body 8 in which a solenoid coil 9 is mounted, an armature 10 arranged in the region of the coil passage, this armature being configured as a cylindrical body, for example, as a solid body and guided in a pump body bore 11 located in the region of the longitudinal centerline of the ring coil 9 where it is urged into its starting position by means of a compression spring 12, it being in connection with the bottom 11*a* of the bore 11 in this position. The compression spring 12 is supported by the face surface area of the armature 10 at the injection end and by a ring step 13 of the bore 11 opposite the surface area. The spring 12 surrounds with clearance a delivery plunger 14 which is fixedly, e.g. integrally connected to the armature 10 at the armature face surface area urged by the spring 12. The delivery plunger 14 plunges relatively deeply into a cylindrical fuel delivery space 15 configured coaxially in the axial elongation of the bore 11 in the pump body 8 and is communicatingly connected to the pressure line 2. Due to the plunging depth pressure losses can be avoided during the sudden increase in pressure, whereby the machining tolerances between plunger 14 and barrel 15 may be relatively large, e.g. merely needing to be in the range of hundredths of a millimeter so that the machining expense is slight.

Arranged in the suction line 4 is a check valve 16. Located in the body 17 of the valve 16 is a ball 18, for instance, as the valve element which in its resting position is urged by a spring 19 against its valve seat 20 at the reservoir end of the valve body 17. For this purpose the spring 19 is supported, on the one hand, by the ball 18 and, on the other, by the wall of the body 17 opposite the valve seat 20 in the region of the port 21 of the suction line 4.

The stop element 6 comprises e.g. a two-part housing 22 in the space of which a diaphragm 23 is tensioned as the element to be displaced, this diaphragm separating a space filled with fuel at the pressure line side from the cavity and which in the relaxed condition separates the cavity into two halves, sealed off from each other by the diaphragm. At the side of the diaphragm facing away from the conductor 7 a spring force, e.g. a spring 24 engages a vacant space, the storage volume. This spring 24 charging this storage volume is fitted as a return spring for the diaphragm 23, it being mounted by its end opposite the diaphragm on a wall of the cylindrical flared cavity. The empty cavity of the body 22 is defined by an arched wall forming a stop surface area 22*a* for the diaphragm 23.

The coil 9 of the pump 1 is connected to a control means 26 serving to electronically control the injection device.

When the coil 9 is non-energized the armature 10 of the pump 1 is in contact with the bottom 11*a* due to the preloading of the spring 12, the fuel supply valve 16 is closed and the storage diaphragm 23 is maintained by the spring 24 in its position out of contact with the stop surface area 22*a* in the body cavity.

When the coil 9 is signalled via the control means 26 the armature 10 and thus the plunger 14 is moved against the force of the spring 12 in the direction of the injector 3, the delivery plunger 14 in connection with the armature 10 displacing fuel from the delivery barrel 15 into the space of the stop element 6. The spring forces of the springs 12, 24 are designed relatively soft so that fuel displaced by the delivery plunger 14 forces the storage diaphragm 23 into the empty space practically with zero resistance during the first partial stroke, as a result of which the armature 10 is initially accelerated almost free of any resistance until the storage volume or empty space volume of the stop element 6 is exhausted by the diaphragm 23 coming up against the arched wall 22*a*. This results in fuel displacement being suddenly halted and the fuel being abruptly compressed by the already high kinetic energy of the delivery plunger 14.

The kinetic energy of the armature 10 and the delivery plunger 14 acts on the fluid, resulting in a pressure impulse which travels through the pressure line 2 to the injector 3 where it causes fuel to be ejaculated.

To end delivery the coil 9 is de-energized. The armature 10 is moved back to the bottom 11*a* by the spring 12, the amount of fuel stored in the storage means 6 being sucked back into the delivery barrel 15 via the lines 7 and 2, and the diaphragm 23 forced back into its starting position due to the effect of the spring 24. At the same time the fuel supply valve 16 opens so that fuel is replenished by suction from the tank 5.

Expediently arranged in the pressure line 2 between the injector 3 and the branches 4, 7 is a valve 16*a* which maintains a standing pressure in the space at the injector side which is e.g. higher than the vapor pressure of the fluid at the maximum occuring temperature so that bubbles are prevented from forming. The standing pressure valve may be configured e.g. like the valve 16.

Figure 4:
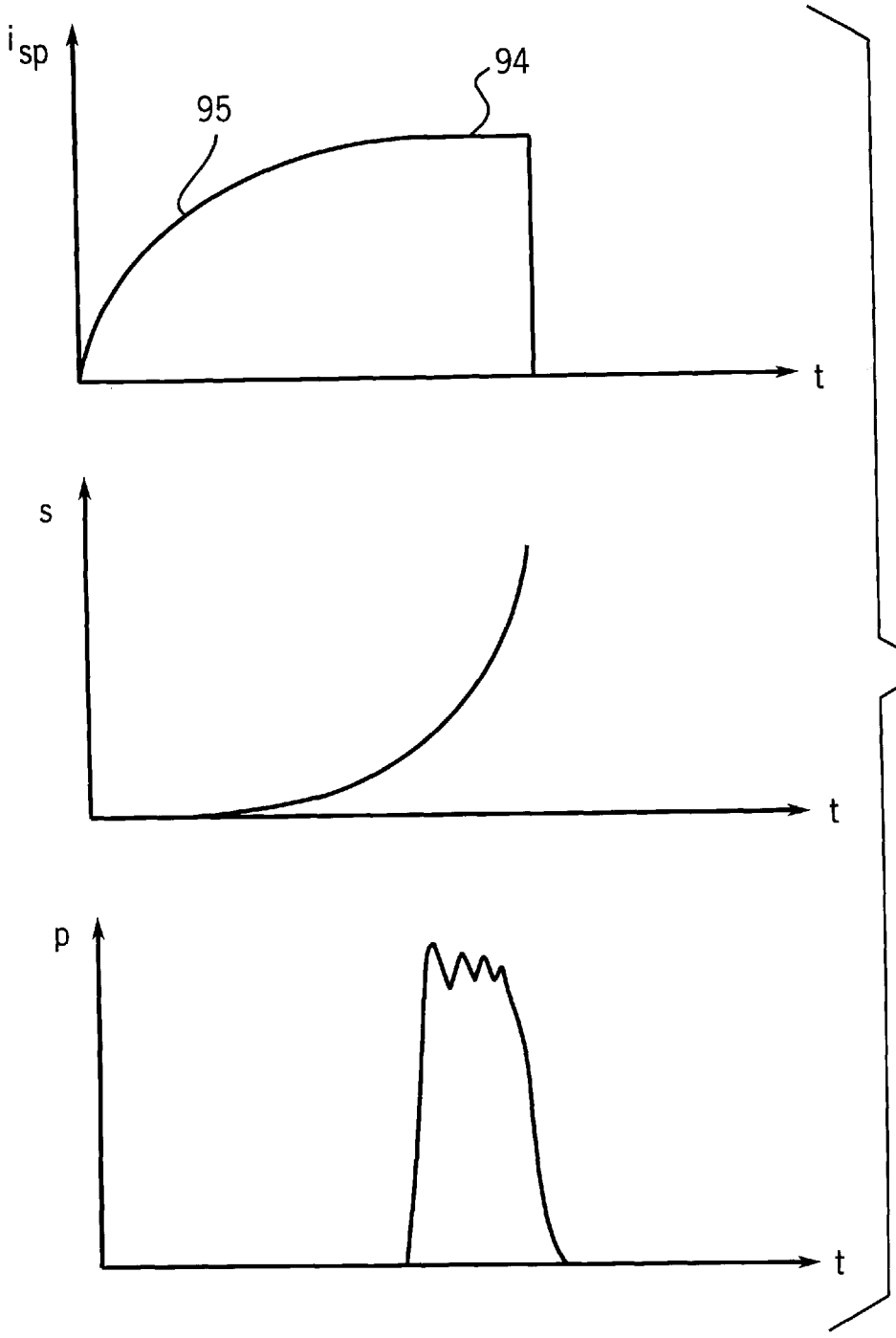
FIG. 4 is a diagram schematically plotting the energizing current $i_{sp}$, the armature stroke s and the injection pressure p as a function of time t.

The energizing or coil current $i_{sp}$ through the energizing coil 9 results in a stroke s of the armature 10 or delivery plunger 14 which is staggered in time relative to the start of the energizing current. The build-up in the injection pressure p occurs in turn staggered in time relative to the stroke s, namely not before displacement of the fuel is suddenly halted, and the fuel is abruptly compressed due to the already high kinetic energy of the delivery plunger 14 (FIG. 4).

The integral of the energizing current $i_{sp}$ with time is roughly proportional to the amount of fuel ejected per injection pulse, the leading edge 95 of the energizing current $i_{sp}$ having a substantial effect on initiation of the injection pressure p since the leading edge 95 initiates acceleration of the armature 10 or delivery plunger 14. Due to the fluctuations of the leading edges of the energizing current pulses 94 as described at the outset in known methods for signalling the energizing coil, more particularly in a pump-injector system, considerable differences thus materialize in the amount of fuel ejaculated per injection pulse for an identical pulse length and the same maximum current strength of the current setpoint curve.

Figure 5:
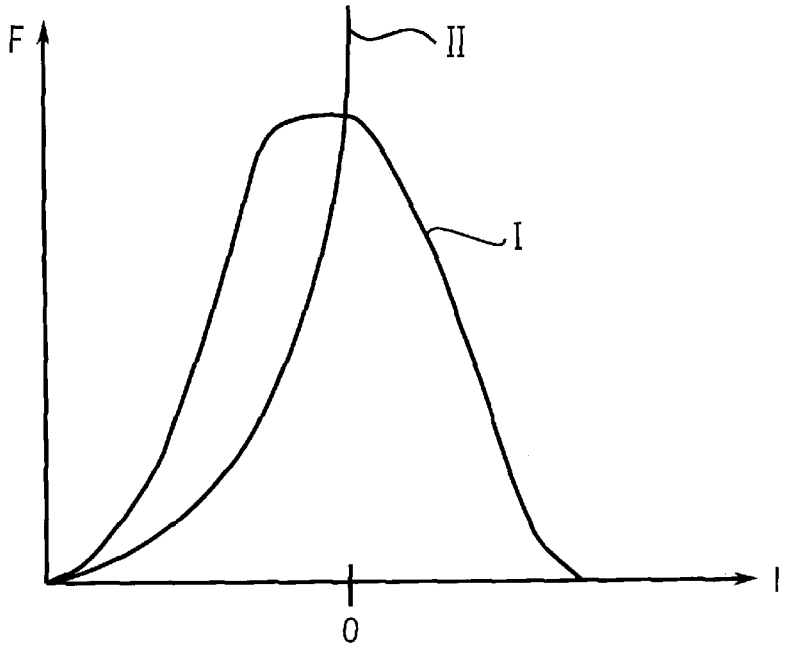
FIG. 5 is a diagram plotting the force F exerted by an armature driven by the energizing coil as a function of a working air gap 1 in the solenoid-operated fuel injection device.

Furthermore, for a predetermined constant energizing current $i_{sp}$ the force exerted by the armature depends on the so-called working air gap which is proportional to the working stroke of the armature. The exponential function profiles of the force exerted by the armature as a function of the working air gap 1 greatly differ, depending on the geometry of the reciprocating plunger pump employed, more particularly as regards the armature, the coil or the surroundings thereof. In FIG. 5, I denotes a function of the force F exerted by the armature deponding on the working air gap 1 which is typical for the fuel injection device as illustrated in FIG. 3. This function may also exhibt, however, a totally different profile, e.g. a gradually rising profile, denoted by II in FIG. 5.

Figure 7:
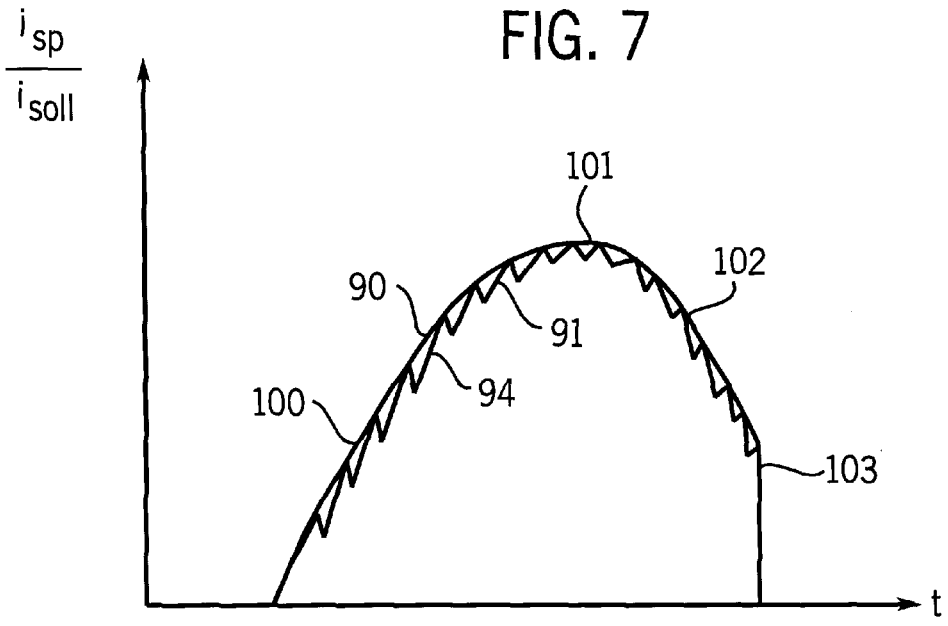
FIG. 7 is a diagram showing the pulse profile of the energizing current adapted to the characteristics of the fuel injection device as shown in FIG. 3.

By means of the method in accordance with the invention a current setpoint curve can be set adapted to such special framework conditions, as given, for example, by the F-1 dependency (FIG. 7) whereby the current setpoint curve features a leading edge 100 which gradually increases, attains an arched maximum 101 before gradually decreasing by the trailing edge 102. The trailing edge 102 may drop off abruptly as of a certain point in time 103. The important thing is that the curve only causes changes in the energizing current $i_{sp}$ which lie within the control range of the current control circuit employed so that it is assured that the energizing current obeys the set current setpoint curve. The gradually decreasing trailing edge 102 in the pulse profile illustrated by way of example in FIG. 7 is adapted to the force (F)/working air gap (1) function denoted I in FIG. 5 since as of a certain working stroke of the armature 10 or as of a certain working air gap 1 a high current prompts only an unsubstantial acceleration at the armature so that a high current would result in minor utilization of the energy supply which would be substantially converted into waste heat. The profile of the current setpoint curve is, however, not restricted to this special more-or-less bell-shaped configuration, it instead to be adapted individually to the reciprocating plunger pump and the geometry thereof employed in each case, i.e. selected so that for a minimum input of electrical energy a maximum delivery output or flow is achieved for each injection pulse.

Figure 1:
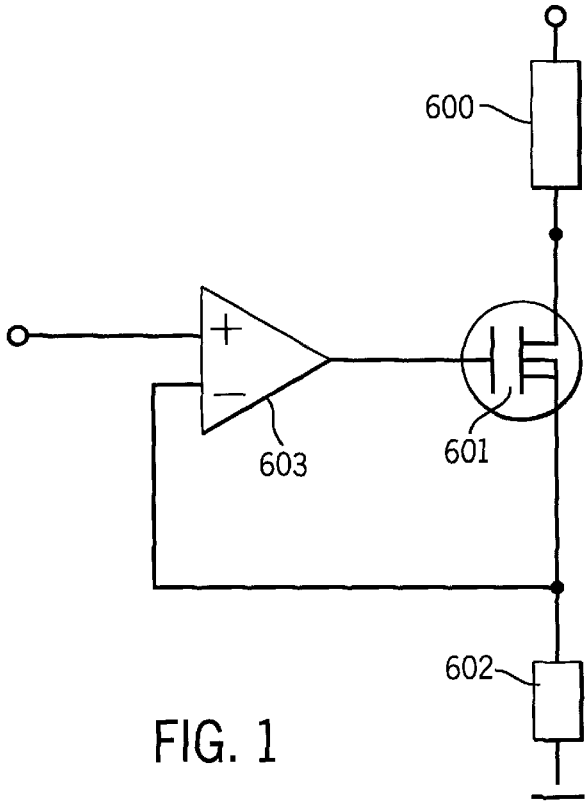
FIG. 1 is a circuit diagram of a current control circuit.
Figure 2:
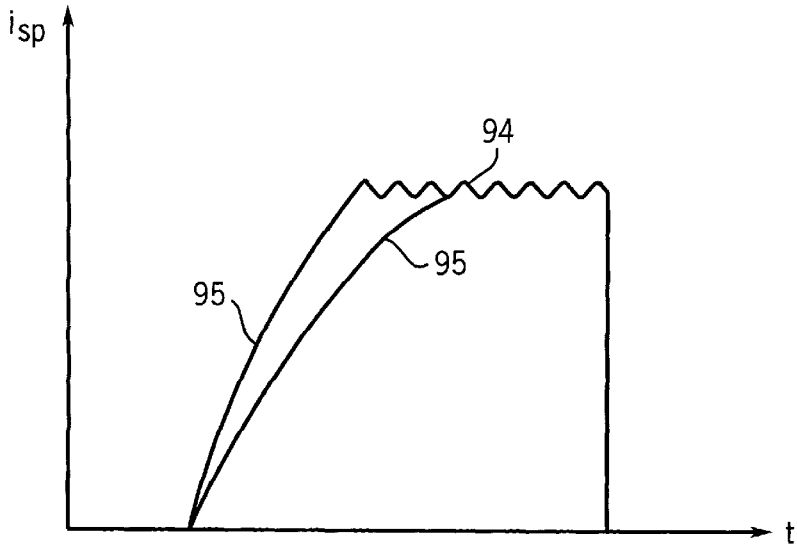
FIG. 2 is a diagram showing the pulse profile of the energizing coil current in accordance with the method known from PCT/EP 93/00494.

Producing the current setpoint curve 90 with a microprocessor may involve significant computation, especially at high speeds. This is why it may be expedient to provide an analog setpoint control circuit (FIG. 8) which generates a pulse-shaped current setpoint curve having a predetermined profile, preferably in the form of an exponential function, for instance, as a function of a square-wave pulse signal 110 and a reference voltage 111. Such a circuit comprises, for example, a resistor 112 and a capacitor 113 and a switch 114 which is generally achieved by a transistor. Applied to the resistor 112 on one side (point B) is the reference voltage 111 whilst the other side of the resistor 112 is connected to one side of the capacitor 113. The capacitor 113 is grounded by its side remote from the resistor 112, it being connected to the connecting lead between the resistor 112 and the capacitor 113 and the grounded side of the capacitor 113 so that it short-circuits the capacitor 113 in the closed condition. For ON/OFF control of the switch 114 the square-wave pulse signal 110 is applied (point A). The current setpoint curve of the set voltage is tapped from the connecting lead between the resistor 112, the capacitor 113 and the switch 114 at point C. Point C is connected to the current control circuit, for example, to the non-inverting input of the comparator 603 of the circuit as shown in FIG. 1.

When the switch 114 in this setpoint control circuit is closed the capacitor 113 discharges abruptly and no voltage is applied to point C. On opening the switch 114 the capacitor 113 is gradually charged via the resistor 112, this charging voltage being tapped from point C as the current setpoint curve (set voltage). The profile of the voltage rise is dictated by the RC pad 112, 113 as an exponential function. The rate of slope of rise of the current setpoint curve tapped from the point C is proportional to the level of the reference voltage applied to point B, this voltage forming the base value U0 in the equation (2). The pulse length is dictated solely by the width of the pulses forming the square-wave pulse signal 110, the length of the pulse of the current setpoint curve being dictated by OFF action of the switch 114, since in the OFF condition of the switch 114 the set voltage for the current setpoint curve is tapped from point C. The length of the OFF pulse of the square-wave control pulse signal 110 thus dictates the length of the energizing current pulse.

By the simple means of this setpoint control circuit a current setpoint curve is generated with pulses in the form of an exponential function, the pulse length of which and their rise can be controlled independently of each other, the profile of the current setpoint curve as a whole corresponding to an exponential function. The current setpoint curve can be adapted to the energizing coil current curve 92 which features the maximum rise in current limited by the mutual induction for the minimum voltage available at the energizing coil so that the current setpoint curve is in the control range of the current control circuit and a maximum amount of fuel can be injected precisely metered.

The corresponding adaptation, implemented in general by the reference voltage 111 ($U_0$), need not be permanently corrected. Instead it may be adapted in time spacings corresponding to one revolution of the engine to which changes in the engine condition are adapted, thus considerably facilitating the control means to be used.

Figure 8:
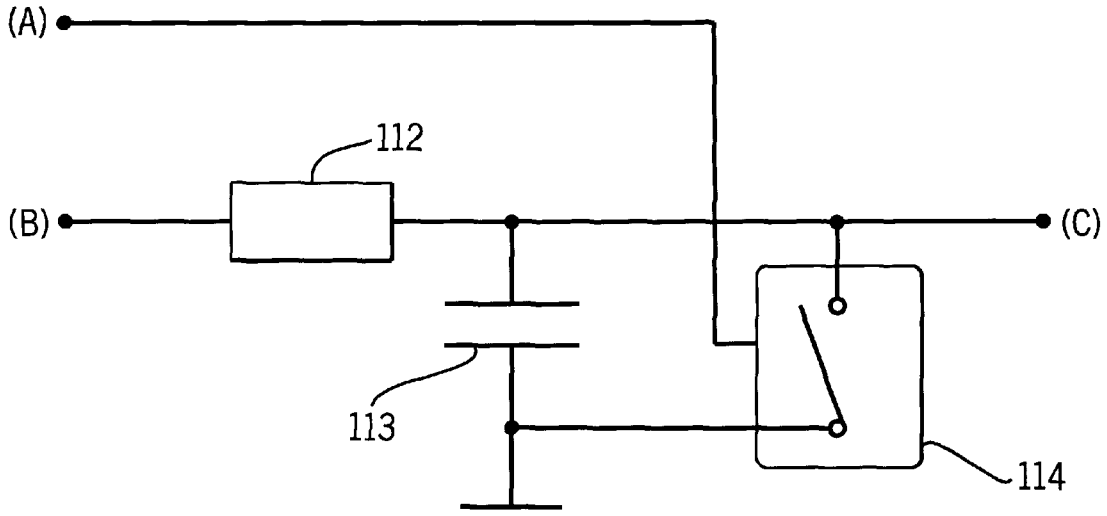
FIG. 8 is a diagram of a circuit in accordance with the invention for generating a current setpoint curve for a current control circuit.
Figure 9A:
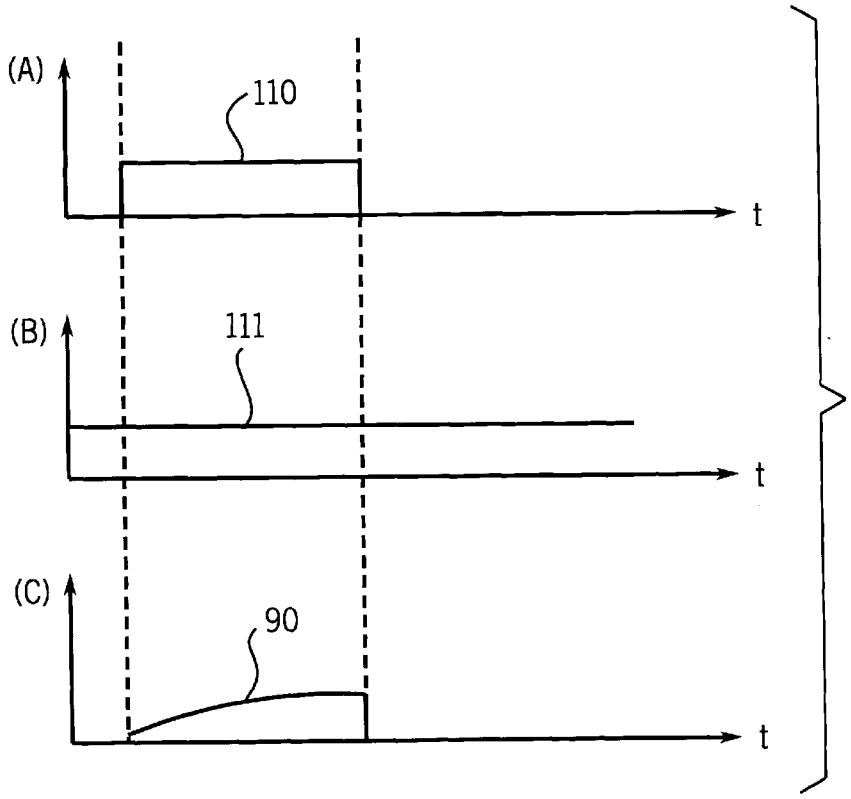
FIGS. 9*a* and 9*b* are diagrams illustrating the current setpoint curve achieved by the circuits shown in FIG. 8.
Figure 9B:
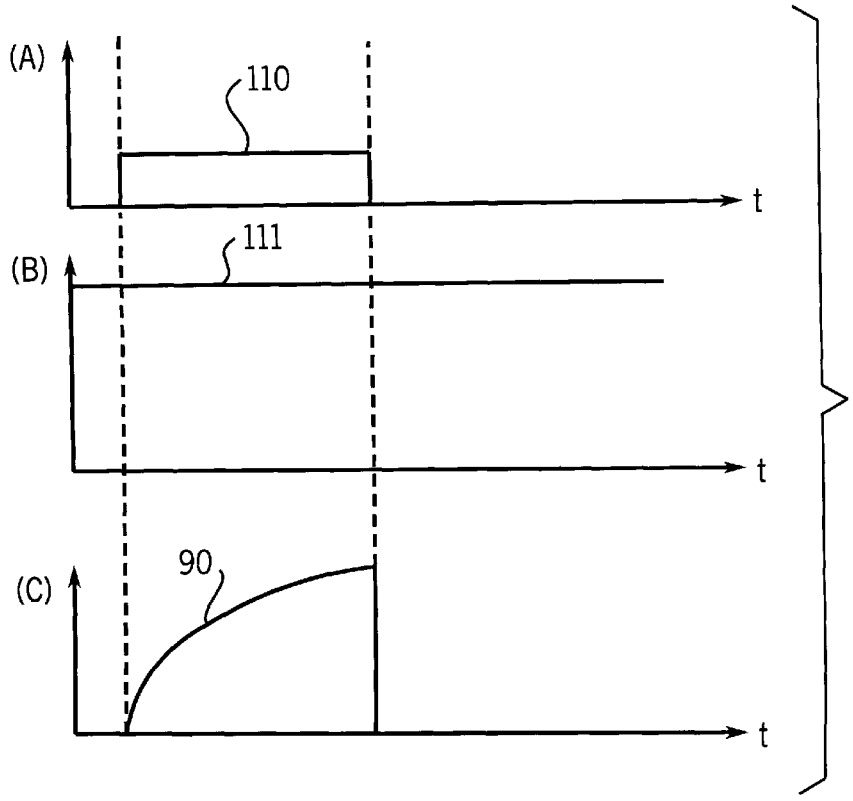

The set current control circuit is not limited to the embodiment as depicted in FIG. 8. Instead it may be varied in arrangement or in the nature of its components. Thus, use can be made of a variable resistor 112 or a variable capacitor 113 so that the reference voltage 11 can remain constant. The resistor 112 or capacitor 113 may be replaced by an active comparator. The set voltage 111 may also be represented by a set current, for example, by means of a RL pad, the set current being tapped via a resistor.

At the end of each energizing current pulse 94 the energizing current 91 and the magnetic field produced thereby collapses since the energizing coil circuit is opened, and thus the end of the energizing current pulse has no effect significantly influencing the amount of fuel per injection pulse.

The method in accordance with the invention is not solely dedicated to metering the amount of fuel, it instead assuring that an ejaculated amount of fuel is made available reproducibly and irrespective of external influencing factors such as voltage and temperature. The amount of fuel is principally set for a specific setpoint profile of the signalling curve over the time duration of the current pulse.

What is claimed is:

1. A method for signaling an energizing coil of a solenoid-operated reciprocating plunger pump employed as a fuel injection device, in which the energizing coil is energized via a current control circuit pulsed at high-frequency by an energizing current and each pulse causes an impulse movement of an armature driven by the energizing coil, and said current control circuit controls said energizing current flowing through said energizing coil as a function of a current setpoint curve, said method comprising the steps of:

forming each pulse of said current setpoint curve with a gradually rising leading edge resulting in a corresponding gradually rising leading edge of said pulse of said energizing current in said energizing coil; and controlling said current setpoint curve so that said energizing current does not change faster than the maximum change in current possible for the minimum voltage available at said energizing coil and limited due to mutual induction.

2. The method as set forth in claim 1 further comprising the step of controlling said gradually rising leading ledge of said current setpoint curve by a profile corresponding to an exponential function.

3. The method as set forth in claim 1 further comprising the step of sensing an engine speed and/or a temperature existing as said energizing coil to adapt said current setpoint curve to the voltage available at said energizing coil.

4. The method as set forth in claim 1 further comprising the step of computing said current setpoint curve by a microprocessor and applying said computed setpoint curve to said current control circuit.

5. The method as set forth in claim 1 further comprising the steps of:

generating said current setpoint curve with a digital/analog converter; and coupling said setpoint curve to said current control circuit as a setting voltage.

6. The method as set forth in claim 1 further comprising the step of forming each pulse of said current setpoint curve as an exponential function over its full pulse profile.

7. The method as set forth in claim 1 further comprising the step of adapting said current setpoint curve to a reciprocating plunger pump having a force (F)/working air gap (1) function that is bell-shaped.

8. The method as set forth in claim 1 further comprising the steps of:

generating the profile of said current setpoint curve by means of a setpoint control circuit;

forming said setpoint control circuit with an RC pad including a resistor and a capacitor; and charging said capacitor via said resistor in regular time intervals to produce a pulse-shaped current setpoint curve corresponding to an exponential function.

9. The method as set forth in claim 1 further including the steps of:

controlling the pulse length and rise of said pulses of said current setpoint curve independently of each other by a square-wave pulse signal being applied to a switch;

short-circuiting said capacitor with said switch; and applying a variable reference voltage in the form of said square-wave pulse signal to said capacitor via said resistor when said switch is open.

10. The method as set forth in claim 1 further comprising the step of using a pump-injector device operating in accordance with the solid-state energy storage principle as the fuel injection device.

* * * * *